US008082828B2

(12) United States Patent
Formon et al.

(10) Patent No.: US 8,082,828 B2
(45) **Date of Patent: *Dec. 27, 2011**

(54) HANDS-FREE POWERED ABSORBENT SHEET DISPENSER

(75) Inventors: John S. Formon, Appleton, WI (US); Russell G. Wieser, Appleton, WI (US)

(73) Assignee: SCA Tissue North America LLC, Philadelphia, PA (US)

( * ) Notice: Subject to any disclaimer, the term of this patent is extended or adjusted under 35 U.S.C. 154(b) by 7 days.

This patent is subject to a terminal disclaimer.

(21) Appl. No.: 12/566,023

(22) Filed: Sep. 24, 2009

(65) Prior Publication Data

US 2010/0012675 A1 Jan. 21, 2010

Related U.S. Application Data

(62) Division of application No. 11/390,187, filed on Mar. 28, 2006, now Pat. No. 7,837,077.

(51) Int. Cl.
*B26F 3/02* (2006.01)

(52) U.S. Cl. ..... 83/649; 312/34.8; 242/563; 242/564

(58) Field of Classification Search ..... 225/10, 225/11, 15, 6; 34/524, 554, 565, 572; 242/563, 242/564, 564.1, 564.3–564.5; 250/221; 83/649; 312/34.8

See application file for complete search history.

(56) References Cited

U.S. PATENT DOCUMENTS

| | | | | |
|---|---|---|---|---|
| 4,666,099 | A | 5/1987 | Hoffmann et al. | |
| 4,721,265 | A | 1/1988 | Hawkins | |
| 4,796,825 | A | 1/1989 | Hawkins | |
| 4,960,248 | A | 10/1990 | Bauer et al. | |
| 5,031,258 | A | 7/1991 | Shaw | |
| 5,452,832 | A | 9/1995 | Niada | |
| 5,772,291 | A | 6/1998 | Byrd et al. | |
| 6,112,631 | A | 9/2000 | Van Alstine | |
| 6,412,679 | B2 * | 7/2002 | Formon et al. | 242/564.4 |
| 6,419,136 | B2 * | 7/2002 | Formon et al. | 225/15 |
| 6,736,348 | B1 * | 5/2004 | Formon et al. | 242/563 |
| 6,742,689 | B2 * | 6/2004 | Formon et al. | 225/10 |
| 6,745,927 | B2 * | 6/2004 | Formon et al. | 242/564.4 |
| 6,820,785 | B2 | 11/2004 | Kapiloff | |
| 6,830,210 | B2 * | 12/2004 | Formon et al. | 242/563 |
| 6,994,408 | B1 | 2/2006 | Bunnell | |
| 7,114,677 | B2 * | 10/2006 | Formon et al. | 242/564.4 |
| 7,341,170 | B2 * | 3/2008 | Boone | 225/10 |
| 7,364,112 | B1 * | 4/2008 | Formon | 242/564.1 |
| 7,416,152 | B2 * | 8/2008 | Wieser et al. | 242/564.1 |
| 7,571,670 | B2 * | 8/2009 | Formon | 83/649 |
| 7,624,664 | B2 * | 12/2009 | Morris et al. | 83/649 |
| 7,837,077 | B2 * | 11/2010 | Formon et al. | 225/6 |
| 2001/0001475 | A1 * | 5/2001 | Formon et al. | 242/564.4 |
| 2001/0017309 | A1 * | 8/2001 | Formon et al. | 225/10 |
| 2002/0135486 | A1 | 9/2002 | Brohagen et al. | |

(Continued)

FOREIGN PATENT DOCUMENTS

EP 1297770 A1 * 4/2003

(Continued)

*Primary Examiner* — Jason Daniel Prone
(74) *Attorney, Agent, or Firm* — Young & Thompson

(57) ABSTRACT

A hands-free dispenser has a body and a cover connected to the body. A sensor element is attached to the body. The cover has an opening that enables the sensor to protrude through the cover and extend beyond a plane of the cover when the cover is closed.

18 Claims, 4 Drawing Sheets

U.S. PATENT DOCUMENTS

| | | | | |
|---|---|---|---|---|
| 2003/0132261 | A1* | 7/2003 | Formon et al. | 225/46 |
| 2003/0168489 | A1* | 9/2003 | Formon et al. | 225/2 |
| 2003/0168550 | A1 | 9/2003 | Formon et al. | |
| 2005/0150992 | A1 | 7/2005 | Morris et al. | |
| 2005/0171634 | A1 | 8/2005 | York et al. | |
| 2006/0102769 | A1 | 5/2006 | Wieser et al. | |
| 2007/0089582 | A1* | 4/2007 | Formon | 83/331 |
| 2007/0145062 | A1* | 6/2007 | Formon et al. | 221/30 |
| 2007/0176041 | A1 | 8/2007 | Friesen et al. | |
| 2007/0194166 | A1 | 8/2007 | Reinsel et al. | |
| 2008/0087758 | A1* | 4/2008 | Formon et al. | 242/563 |
| 2010/0012674 | A1* | 1/2010 | Brownlee | 242/564.4 |
| 2010/0078459 | A1* | 4/2010 | Reinsel et al. | 225/10 |
| 2010/0133288 | A1* | 6/2010 | Formon et al. | 221/45 |
| 2010/0176237 | A1* | 7/2010 | Friesen et al. | 242/564.4 |

FOREIGN PATENT DOCUMENTS

| | | | |
|---|---|---|---|
| WO | WO 9959457 | A1 * | 11/1999 |
| WO | WO 03078286 | A1 * | 9/2003 |
| WO | WO 2006054965 | A2 * | 5/2006 |
| WO | WO 2010065215 | A1 * | 6/2010 |

* cited by examiner

HANDS-FREE POWERED ABSORBENT SHEET DISPENSER

CROSS REFERENCE TO RELATED APPLICATIONS

This application is a division of application Ser. No. 11/390,187 filed on Mar. 28, 2006, currently pending. The entire contents of the above-identified application is hereby incorporated by reference.

BACKGROUND OF THE INVENTION

1. Field of the Invention

The invention relates to a hands-free dispenser for absorbent sheet products contained in roll form within a dispenser body, preferably paper towels.

2. Description of Related Art

Hands-free paper towel dispensers in which the towels are supplied in roll form are widely used in commercial establishments and have the advantage of relatively high capacity, and thus a less frequent need to replace the rolls. In addition, many users prefer these types of dispensers for hygienic reasons because the user need not touch the dispenser to obtain a quantity of paper towel. Current commercial embodiments of these paper towel housings are often made from molded plastics that are translucent or have white or off-white colors.

A number of prior art hands-free dispensers have a hand sensor mounted behind the front cover, which gives rise to certain limitations as will be discussed below.

SUMMARY OF THE INVENTION

The invention provides hands-free dispenser comprising a dispenser body adapted to receive a roll of absorbent sheet products to be disposed within the dispenser; a cover secured to the dispenser body while permitting the cover to be opened for service of the dispenser or replacement of a roll of absorbent sheet products therein, the cover having an opening; and a sensor connected to the dispenser body and extending at least part way through the opening to protrude beyond a main plane of the cover when the cover is closed.

BRIEF DESCRIPTION OF THE DRAWINGS

Other objects, features and advantages of the invention will become more apparent after reading the following detailed description of preferred embodiments of the invention, given with reference to the accompanying drawings, in which.

DETAILED DESCRIPTION OF PREFERRED EMBODIMENTS

Figure 1:
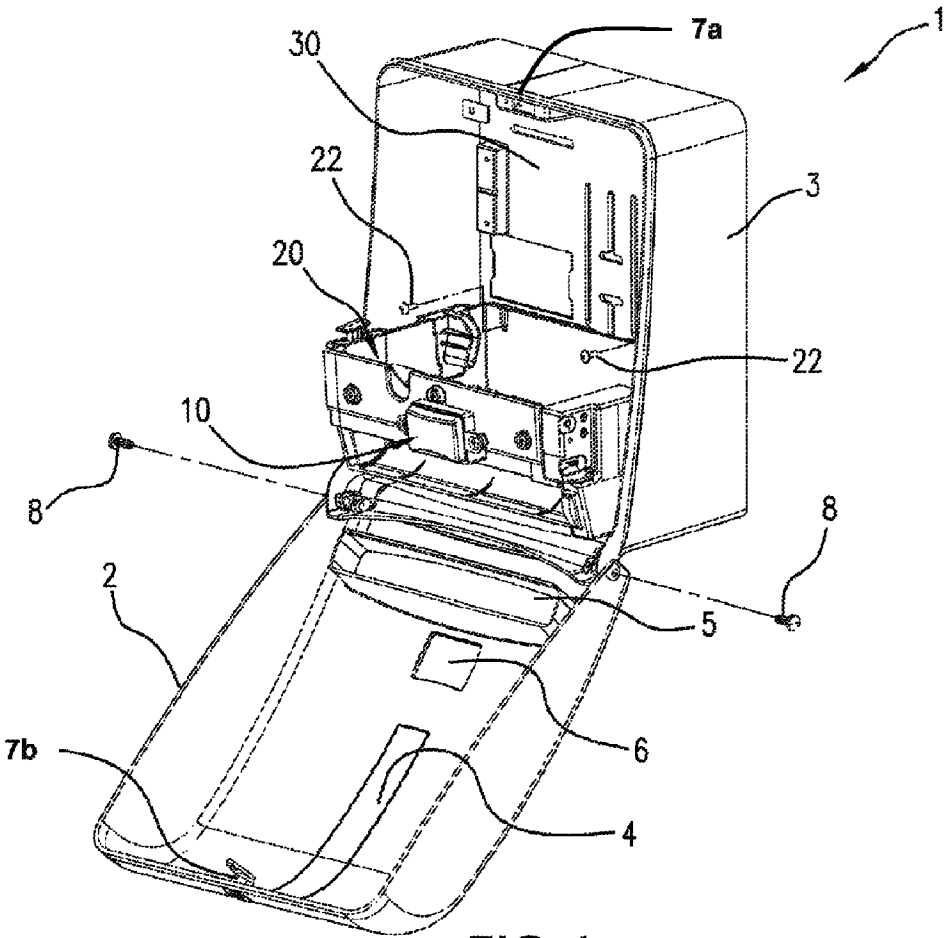
FIG. 1 is a perspective view showing an embodiment of a dispenser according to the present invention.

In FIG. 1, it can be seen that the dispenser 1 comprises a cover 2 and a body portion 3. The cover 2 in this embodiment is pivotally mounted to the body portion 3 via pivot pins 8 that pass through complementary aligned openings in the cover 2 and body portion 3, although another hinge type or other pivotal mounting structure could also be used. The term "hinge structure" is used broadly herein to designate any structure that allows the cover to be pivotally mounted to the cover. The cooperating hinge structures could also take the form of bosses formed on the dispenser body that fit within openings formed on the cover.

Figure 3:
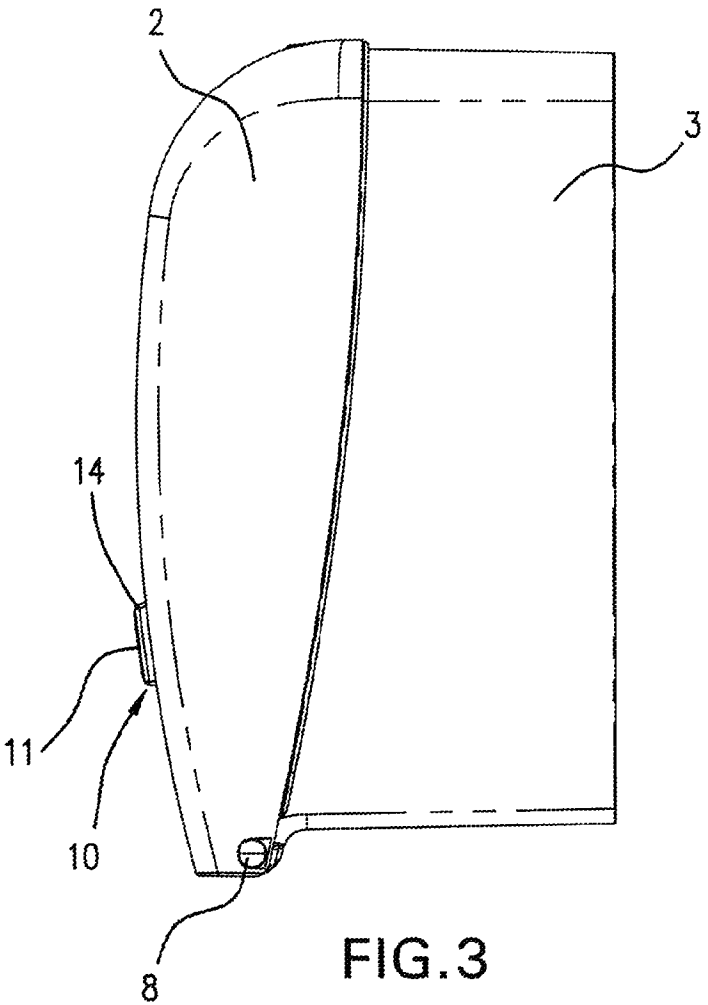
FIG. 3 is a side view showing the dispenser according to FIG. 1 with the cover closed.
Figure 2:
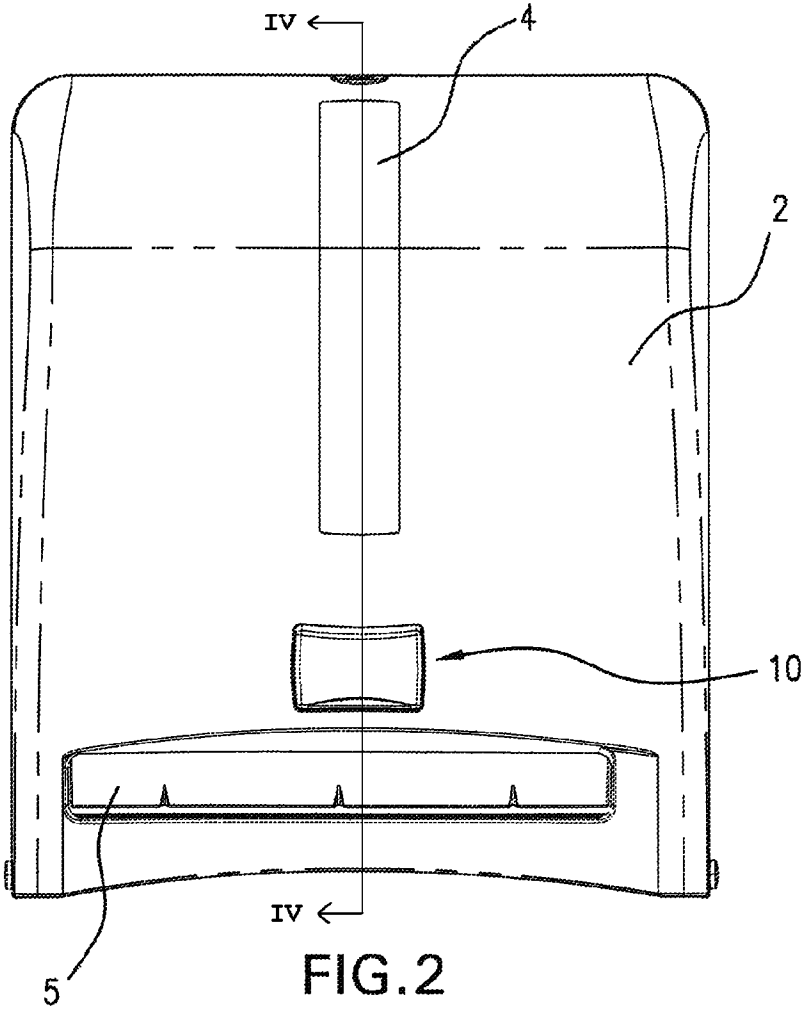
FIG. 2 is a front view showing the dispenser according to FIG. 1 with the cover closed.

With the cover closed as shown in FIG. 3, the cover 2 is held to the body portion 3 by a lock having a first locking structure 7*a* on the body portion 3 and a second locking structure 7*b* on the cover 2, which involves a conventional key-actuated locking structure engaging with a cooperating locking structure on the body portion 3.

In the presently preferred embodiment, the dispenser is a powered hands-free dispenser having an object sensor 10. The object sensor 10 detects, for example, the presence of a user's hand, and in response to that detection automatically dispenses a predetermined or adjustable length of paper towel, which the user then tears off by pulling the towel against a cutting blade disposed inside the dispenser housing. The type of sensing is not limited in this invention, and could be for example passive or active infrared sensing, or sensing based on disruption of an electromagnetic field generated between a transmitting and receiving antenna.

As seen in FIG. 1, the body portion 3 supports the entirety of the object sensor 10. Thus, when the cover 2 is opened, the object sensor 10 remains joined to the body portion 3 without any part of the sensor being connected to the cover 2. Therefore, the openings in the cover 2 including dispensing opening 5, and sensor opening 6 are distinctly defined.

Figure 5:
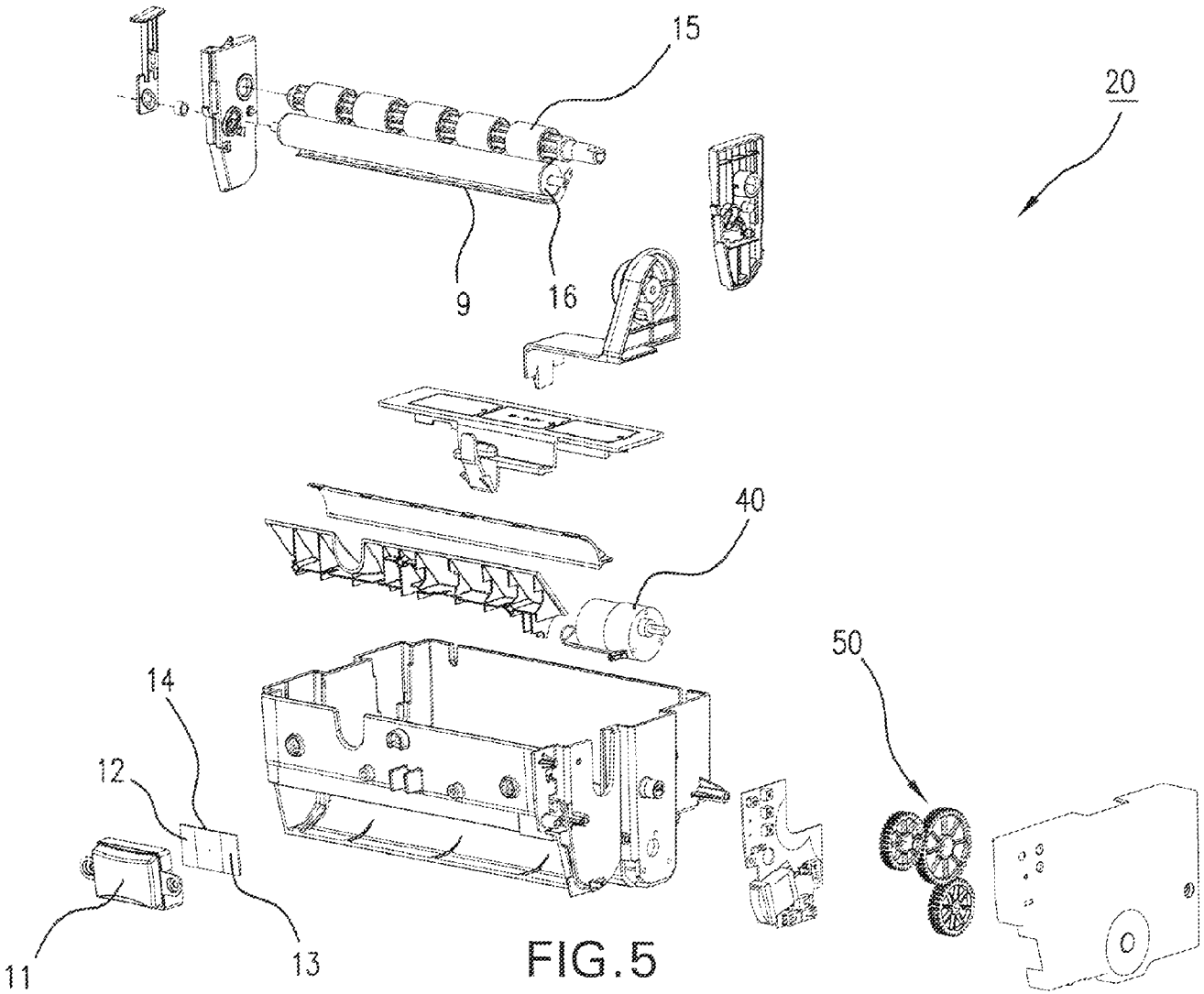
FIG. 5 is an exploded view of a cassette of FIG. 1.

In the presently preferred embodiment, the sensor 10 is part of a cassette 20 (see FIGS. 1 and 5) that is removable from the remainder of the body portion 3. Thus, reference to the "body portion" herein includes in this embodiment both the cassette and the remaining wall-mounted rear portion of body portion 3. The cassette also includes a motor 40 and gearing 50 to drive a drive roller 15 which faces nip roller 16, for unwinding material from the roll of absorbent material R when the sensor 10 is activated. The cassette 20 may also include a cutting member 9 for cutting sheets of absorbent material that are to be dispensed through the dispensing opening 5.

Figure 6:
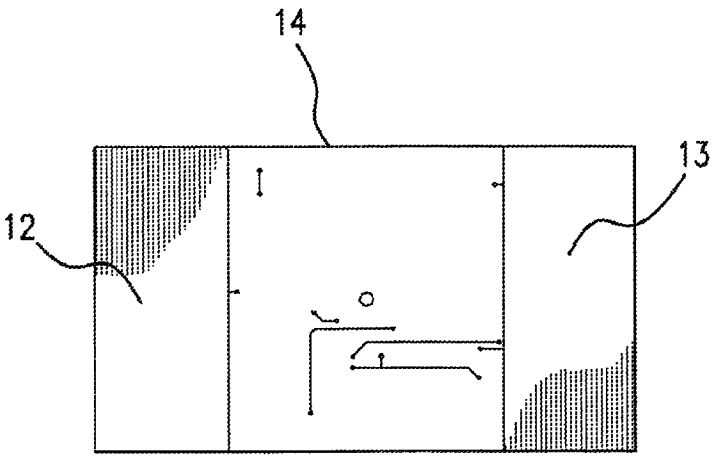
FIG. 6 is a front view of an embodiment of a sensor according to a preferred embodiment of the invention.
Figure 4:
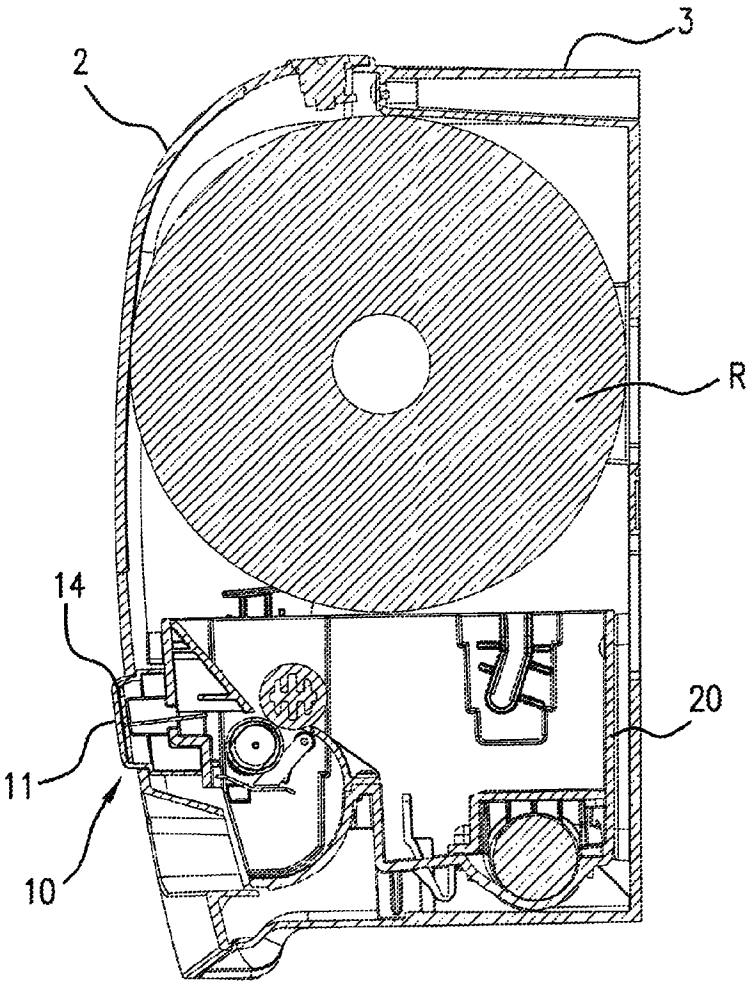
FIG. 4 is a sectional view through the line IV-IV of FIG. 2.

In the presently preferred embodiment as seen in FIGS. 4 and 6, the object sensor 10 includes an antenna printed circuit board (PCB) 14 having a pair of antennae 12, 13 thereon. The antenna PCB 14 and antennae 12, 13 in this embodiment remain outside a plane of the cover 2 when the cover is closed and extend through the sensor opening 6. In greater detail, the PCB 14 preferably is disposed entirely forward of a plane containing at least part of each of the upper and lower outer edges of the opening 6, when the cover is closed. The PCB 14 preferably projects at least partially through the opening 6, it being understood that the area of the dispenser cover 2 surrounding opening 6 is a non-recessed region of the cover 2.

A sensor lens 11 preferably surrounds the antenna PCB 14 and antenna 12, 13 to protect them. An advantage of this configuration of the antenna PCB 14 and antenna 12, 13, is that it allows the cover 2 and/or the body portion 3 to be made from stainless steel, aluminum or other metal material, or metallized or metal-plated plastic material, without disruption of the electromagnetic field or IR radiation that might occur if the sensor were disposed behind a metallized or metal cover. Of course, the invention is nonetheless not limited to the use of a metal or metallized or metal-plated cover. A further advantage of this arrangement is that it eliminates the need for an external wiring harness to connect the sensor to a control board.

In alternative embodiments, cover 2 and body portion 3 may be made by injection molding of plastic. When the dispenser is plastic, cover 2 may be entirely opaque or mainly opaque or translucent, except in an area of the window 4, which is preferably transparent.

Returning to FIG. 1, the body portion 3 comprises a rear mounting surface 30 that is generally perpendicular to the top, bottom and side surfaces. In the embodiment of FIG. 1, the rear mounting surface 30 includes mounting holes for mounting cassette 20 thereto. When the screws 22 holding the cassette 20 to the rear mounting surface 30 are unscrewed, the cassette may be readily slid from the body portion to, for example, enable batteries (not shown) that power the dispenser to be changed or so that the cassette can be returned to the manufacturer for repair and/or software upgrades. A replacement cassette may then be exchanged for the first cassette so that the dispenser can remain in use. Although a battery-operated dispenser is preferred, a hard-wired or plug-in or solar-powered dispenser is also within the scope of the present invention.

As to the roll of absorbent sheet material to be dispensed from the dispenser, this roll may either be a continuous imperforate roll, which is detached from the roll by the user pulling the dispensed sheet against a cutting blade of the cutting member 9, or may instead be a partially pre-cut web in which the force of the user pulling on the dispensed sheet serves to sever the tabs that connect the dispensed sheet to the next sheet to be dispensed, as is common in hands-free mechanical dispensers. Those pre-cuts can be made either during manufacturing converting of the roll, or in-situ by a blade in the dispenser that pre-cuts the tail of the sheet as it is being dispensed.

The term "absorbent sheet products" as used herein embraces not only paper products such as paper napkins, but also absorbent nonwoven materials not normally classed as papers or tissues. Such nonwoven materials include pure nonwovens and hybrid nonwoven/pulp webs whose properties are similar to those of tissue paper, but which are based for example on nonwoven or airlaid materials containing low amounts of synthetic fibers, binders, wet strength agents and the like. An example of such a material would be a wetlaid or foam-formed hydraulically entangled nonwoven material comprising at least 30% by weight pulp fibers and at least 20% by weight manmade fibers or filaments.

While the present invention has been described in connection with various preferred embodiments thereof, it is to be understood that those embodiments are provided merely to illustrate the invention, and should not be used as a pretext to limit the scope of protection conferred by the true scope and spirit of the appended claims.

The invention claimed is:

1. A hands-free dispenser for dispensing lengths of absorbent sheet products from a roll to be disposed within said dispenser, said dispenser comprising:

a dispenser body;

a cover pivotally connected to said dispenser body, said cover having an opening; and an object detecting sensor that at least partially projects through said opening forwardly of the cover when the cover is closed, said sensor comprising at least one antenna disposed entirely forward of a plane containing at least part of upper and lower outer edges of said opening when said cover is closed.

2. The dispenser as claimed in claim 1, further comprising a cassette mounted within said dispenser body and including a drive mechanism that unrolls lengths of absorbent sheet products when said object detecting sensor is activated.

3. The dispenser as claimed in claim 2, wherein said cover is made from stainless steel or aluminum.

4. The dispenser as claimed in claim 2, wherein said cover is a plated metal cover.

5. The dispenser as claimed in claim 1, wherein said dispenser body comprises a rear mounting surface, said dispenser body further comprising a first hinge structure and a first lock structure, said cover comprises a second hinge structure engaging said first hinge structure to secure the cover to the dispenser body while permitting the cover to be opened for service of said dispenser or replacement of a roll of absorbent sheet products therein, and a second lock structure adapted to engage the first lock structure to secure the cover in a closed position, said cover having another opening permitting passage of lengths of absorbent sheet products to pass therethrough, said opening being above said another opening; and wherein said sensor is supported by said dispenser body when said cover is open.

6. The dispenser according to claim 5, wherein said cover is made from stainless steel or aluminum.

7. The dispenser according to claim 5, wherein said cover is made from injection-molded plastic.

8. The dispenser according to claim 7, wherein said cover is opaque or translucent over most of a surface area of the cover, and comprises a transparent window formed therein.

9. The dispenser according to claim 5, further comprising a drive mechanism within said housing, said sensor and said drive mechanism being integral.

10. The dispenser according to claim 9, wherein said drive mechanism and said sensor are part of a cassette that is releasably attached to said rear mounting surface.

11. The dispenser as claimed in claim 10, further comprising a cutting member that cuts lengths of absorbent sheet product dispensed from said first opening.

12. A hands-free dispenser for dispensing lengths of absorbent sheet products from a roll to be disposed within said dispenser, said dispenser comprising:

a dispenser body;

a cover having a front surface and side surfaces, said cover being pivotally connected to said dispenser body at said side surfaces, said cover having an opening in said front surface; and an object detecting sensor comprising at least one antenna that at least partially projects through said opening forwardly of said front surface of the cover when the cover is closed.

13. The dispenser as claimed in claim 12, wherein said sensor is an object detecting sensor that when activated sends a signal for the dispenser to dispense a sheet of absorbent sheet product through said first opening.

14. The dispenser as claimed in claim 13, further comprising a motor and a drive roller connected to said motor, said signal energizing said motor to rotate said drive roller and dispense a sheet of absorbent sheet product through said first opening.

15. The dispenser as claimed in claim 14, further comprising a cutting member for cutting a sheet of absorbent sheet product dispensed through said first opening.

16. The dispenser according to claim 12, wherein said cover is made from stainless steel or aluminum.

17. The dispenser according to claim 12, wherein said cover is made from injection-molded plastic.

18. The dispenser according to claim 17, wherein said cover is opaque or translucent over most of a surface area of the cover, and comprises a transparent window formed therein.

* * * * *